US009724580B2

(12) United States Patent
Goldwitz

(10) Patent No.: US 9,724,580 B2
(45) Date of Patent: Aug. 8, 2017

(54) REMOVABLE AND CONFIGURABLE SPORTING GOAL TARGET AND TARGET POCKETS

(71) Applicant: Brian Goldwitz, New Haven, CT (US)

(72) Inventor: Brian Goldwitz, New Haven, CT (US)

(73) Assignee: SHELTERIT, LLC, Waterbury, CT (US)

( * ) Notice: Subject to any disclaimer, the term of this patent is extended or adjusted under 35 U.S.C. 154(b) by 0 days.

(21) Appl. No.: 14/336,954

(22) Filed: Jul. 21, 2014

(65) Prior Publication Data

US 2016/0016060 A1 Jan. 21, 2016

(51) Int. Cl.

| | |
|---|---|
| ***A63B 69/00*** | (2006.01) |
| *A63B 63/00* | (2006.01) |
| *A63B 102/14* | (2015.01) |

(52) U.S. Cl.

CPC ..... *A63B 69/00* (2013.01); *A63B 63/00* (2013.01); *A63B 63/004* (2013.01); *A63B 69/0024* (2013.01); *A63B 69/0026* (2013.01); *A63B 2102/14* (2015.10); *A63B 2209/10* (2013.01); *A63B 2243/0025* (2013.01)

(58) Field of Classification Search

CPC ..... A63B 63/00; A63B 63/004; A63B 2024/0046; A63B 69/0026; A63B 69/002

USPC ..... 273/446, 398–402

See application file for complete search history.

(56) References Cited

U.S. PATENT DOCUMENTS

| | | | | | |
|---|---|---|---|---|---|
| 3,856,298 | A * | 12/1974 | Frantti | 473/446 |
| 3,887,181 | A * | 6/1975 | Samaras | 473/446 |
| 3,944,223 | A * | 3/1976 | Bromwell | 473/446 |
| 4,948,147 | A * | 8/1990 | Pallanca | 273/402 |
| 5,238,243 | A * | 8/1993 | Grispi | 473/446 |
| 5,725,444 | A * | 3/1998 | Heden | 473/446 |
| D413,949 | S * | 9/1999 | Oudemool et al. | D21/705 |
| 6,012,994 | A * | 1/2000 | Beluse | 473/446 |
| 6,695,724 | B2 * | 2/2004 | Birss | 473/446 |
| 7,037,219 | B2 * | 5/2006 | Pakieser | 473/446 |
| 8,187,123 | B2 * | 5/2012 | Pettys et al. | 473/446 |
| 8,246,494 | B2 * | 8/2012 | Stephenson | 473/446 |
| 2002/0151387 | A1 * | 10/2002 | Henson | 473/446 |
| 2006/0033282 | A1 * | 2/2006 | Fenwick | 273/398 |
| 2007/0265115 | A1 * | 11/2007 | Farquhar | 473/446 |
| 2013/0023362 | A1 * | 1/2013 | Siefker | 473/446 |
| 2014/0045628 | A1 * | 2/2014 | Krohl et al. | 473/446 |
| 2014/0087894 | A1 * | 3/2014 | Siefker | 473/446 |
| 2014/0243118 | A1 * | 8/2014 | Weston | 473/470 |
| 2015/0196819 | A1 * | 7/2015 | Markham | 473/446 |

* cited by examiner

*Primary Examiner* — Mark Graham

(74) *Attorney, Agent, or Firm* — Loza & Loza, LLP; Julio Loza

(57) ABSTRACT

An assembly for modifying/adapting a practice goal to serve as a sporting game practice aid. The assembly suitably includes a target and/or plurality of target pockets that can be removably coupled to the practice goal. This provides a physical target towards which to aim a sporting object (including a puck, ball, and/or the like), and thereby a means of evaluating one's progress towards mastery of the task at hand.

18 Claims, 6 Drawing Sheets

REMOVABLE AND CONFIGURABLE SPORTING GOAL TARGET AND TARGET POCKETS

FIELD OF INVENTION

The present invention is directed to a practice goal for a sporting game. More particularly, the present invention is directed to a goal for a sporting game (e.g., hockey, soccer, lacrosse, etc.) that features certain practice-related elements for enabling a sport player to refine his/her skill.

BACKGROUND OF INVENTION

In conventional approaches, individuals practice their shooting technique by shooting a puck or ball-like article into an open goal, often times to certain locations that are harder for a goalie to defend. However, when shooting at an open goal without a goalie present, individuals are forced to visualize the boundaries of these select locations and must determine their performance by eye, without the aid of a physical feedback mechanism with which to measure their progress. While some current models attempt to address the aforementioned issues using a fixedly coupled assembly, the invention instead comprises various individually removable/replaceable elements, alleviating the need to frequently replace the entire assembly due to wear/deterioration caused by multiple repetitions of high velocity impacts.

SUMMARY OF INVENTION

A first embodiment provides an assembly for modifying/adapting a sporting goal comprising of a plurality of target pockets and a pocket fastener. The plurality of target pockets is adapted to be removably coupled to a front frame of the sporting goal proximate to the corners and/or edges of the frame. The pocket fastener is adapted to be removably coupled to the front frame of the sporting goal and/or the plurality of target pockets running at least partially around the perimeter of the front frame of the sporting goal. The pocket fastener further comprises of an adjustment mechanism for pulling the pocket fastener taut when coupled with the front frame of the sporting goal.

A second embodiment provides an assembly for modifying/adapting a sporting goal comprising of a target adapted to be removably coupled to a front frame of the sporting goal. The target is adapted with at least one fastening mechanism including a double d-ring, snap closure, Velcro™, or the like for attaching the target to the front frame of the sporting goal.

A third embodiment provides an assembly for modifying/adapting a sporting goal comprising of a plurality of target pockets and a target. The plurality of target pockets is adapted to be removably coupled proximate to the corners of the sporting goal and/or various holes/openings in the target. The target is adapted to be removably coupled to the front frame of the sporting goal and/or the plurality of target pockets. The target is equipped with at least one fastening mechanism including a double d-ring, snap closure, Velcro™, or the like for attaching the target to the front frame of the sporting goal.

DETAILED DESCRIPTION

Disclosed is an assembly for modifying/adapting a sporting goal. As will be further explained hereinafter, the assembly features certain modifying/adapting elements that can configure a goal to serve as a sporting game practice aid. For example, the assembly may be coupled to any type of sporting goal, preferably one in which a ball-like article is aimed and shot at a net-bearing goal, such as ice hockey, field hockey, soccer and the like, for the use of honing one's shooting abilities. Under current conventions, an individual must often practice using an empty goal, lacking a goalie, and thus must visualize certain desirable target locations that are considered hard to defend. The invention alleviates this by providing a tangible/physical target as well as a physical mechanism for evaluating the progress of one's shooting abilities.

The following detailed description discusses the invention in terms of exemplary embodiments. The description is not to be construed as limiting, but is merely a discussion of the general principles of the invention.

Figure 1:
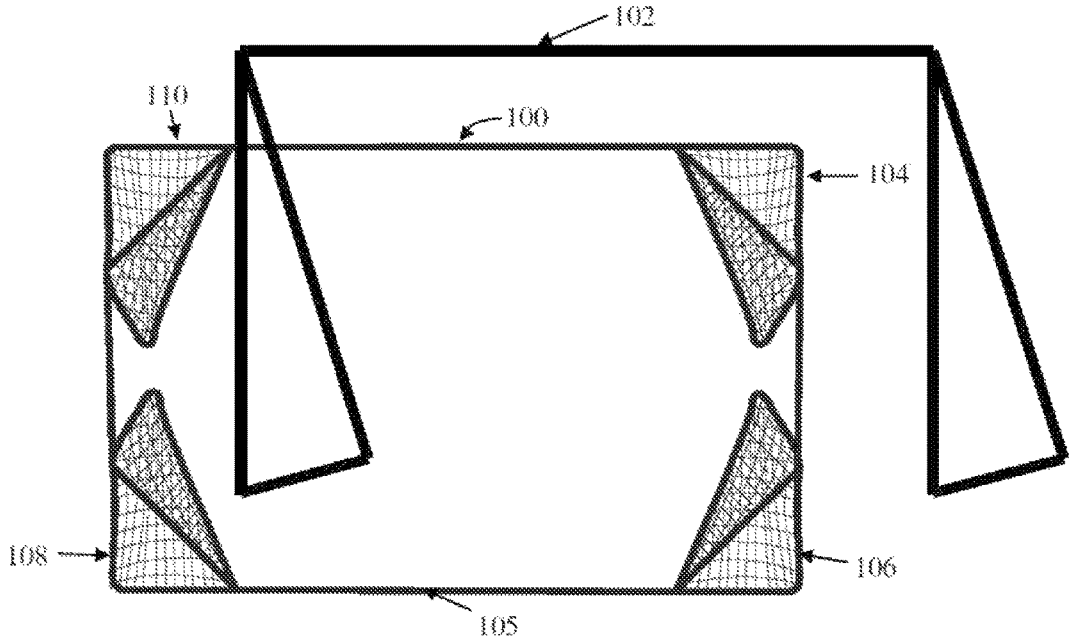
FIG. 1 illustrates an exemplary goal frame with a removable target device including a plurality of target pockets.

FIG. 1 illustrates an exemplary goal frame 102 with a removable target device 100 including a plurality of target pockets 104, 106, 108, 110. The goal frame 102 may be a sporting goal that includes a front frame comprising two vertical support members and a horizontal support member along the top, with no horizontal support member along the bottom face of the goal opening. The removable target device 100 may include a plurality of target pockets 104, 106, 108, 110 coupled together by a fastening element 105, such as a rope, strand, ribbon, cable, etc. In one example, the target pockets 104, 106, 108, 110 may be permanently coupled or affixed to the fastening element 105. The removable target device 100 may be removably coupled to the goal frame 102 while the fastening element 105 may be adjustable to tighten around the goal frame 102 face or opening.

The target pockets 104, 106, 108, 110 of the target device 100 may be fastened or coupled to each corner of the goal frame 102 (top right corner target pocket 104, bottom right corner target pocket 106, bottom left corner target pocket 108, top left corner target pocket 110). Note that, in other embodiments, additional target pockets may be coupled to the fastening element 105 along edges of the frame 102. The placement of the target pockets 104, 106, 108, 110 preferably corresponds to certain target areas of the goal frame 102 considered hard to defend, and thus may provide a physical target to aim at for shooting practice.

Since shooting practice often consists of multiple repetitions of high velocity shots into such target pockets 104, 106, 108, 110, the removable coupling of the target pockets 104, 106, 108, 110 allows them to be removed and/or replaced as they suffer from wear/deterioration. In one example, the target device 100 may be removable and replaceable as a unit. In other examples, individual pockets may be removable and/or replaceable from the fastening element 105.

Despite the target pockets 104, 106, 108, 110 being pictured as composed of netting (see FIGS. 1-2, 4-7), it should be noted that any suitable material may be used to fashion these target pockets. This may include, but is not limited to, openwork (including netting) or a continuous material (including cloth, mesh, canvas, etc.).

As a previously noted, the plurality of target pockets 104, 106, 108, 110 may be linked together by a fastening element 105. The fastening element 105 may run at least partially around the perimeter of the goal frame 102 and may be equipped with an adjustment mechanism (see element 404 in FIG. 4) for pulling the fastening element 105 taut when coupled to the goal frame 102.

While the target device 100 is illustrated as a single, continuous unit running along the entire perimeter of the goal frame 102, other implementations of the target device may include multiple separate pieces or sections that run along one or more select portions/sides/edges of the goal frame 102, and couple/link/connect any plurality of target pockets 104, 106, 108, 110. The fastening element 105 may run along at least the bottom edge of the goal frame 102 and may be fixedly or removably coupled to the target pockets 106, 108 at the bottom left and bottom right corners of the goal frame 102. By fastening the target pockets 106, 108 at the bottom left and bottom right corners to the goal frame 102, this permits tightening the fastening element 105 along the bottom edge of the goal frame 102. In turn, this acts to support the target pockets 106, 108 and enables them to retain their shape in the absence of a bottom segment of the goal frame 102.

In some embodiments, rather than coupling all target pockets 104, 106, 108, 110 together to a single fastening element 105, target pockets 104, 106, 108, 110 may be coupled together in pairs. For instance, a first target pocket 106 and second target pocket 108 may be coupled together using a first fastening element while a third target pocket 104 and fourth target pocket 110 may be coupled together using a second fastening element. In such example, the first target pocket 106 and second target pocket 108 are separate and not coupled to the third target pocket 104 and fourth target pocket 110.

Figure 2:
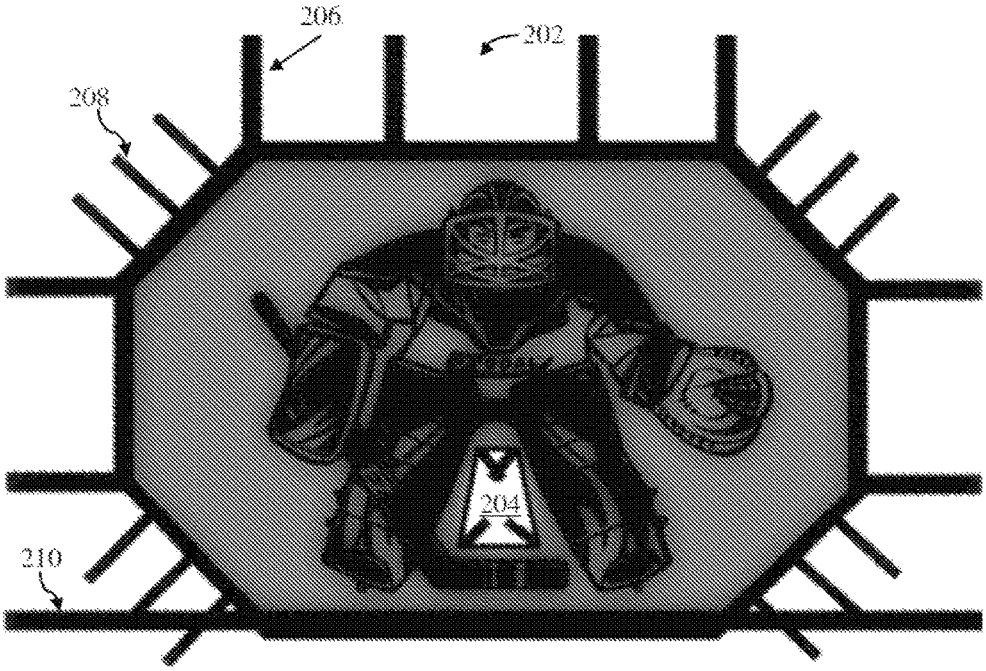
FIG. 2 illustrates a front view of an exemplary target that may be removably coupled to the goal frame.

FIG. 2 illustrates a front view of an exemplary target 202 that may be removably coupled to the goal frame 102. This allows for future replacement of the target and also allows the goal frame 102 to be used in multiple ways. The target 202 covers/obstructs at least 50% of the front opening or face of the goal frame 102, leaving a physical border around certain target regions of the goal frame 102. The target 202 may be made of any suitable material, preferably a non-rigid/flexible material with the ability to absorb force from an object striking it, including vinyl, cloth, polyethylene, or the like. The target 202 may also define one or more additional target openings 204 to which one or more additional target pockets may be removably coupled. One such exemplary target pocket 202, located in the region of the goal that corresponds to that between the goalie's legs, is shown in FIG. 2.

The target 202 may include a plurality of frame fasteners 206 adaptable to couple the perimeter of the target 202 to the vertical support members and top horizontal support member of the goal frame 102. Additionally, the target 202 may include a plurality of target pocket fasteners 208 adaptable to couple the target 202 to one or more target pockets 104, 106, 108 and 110. Likewise, another plurality of target pocket fasteners may be adaptable to couple a target pocket around the perimeter of the additional target opening 204.

The target 202 is also include a supportive strap 210 proximate to the bottom edge of the target 202. The supportive strap 210 may be made using any suitable material (including polypropylene, rope, cord, fabric, etc.) and may be equipped with some form of attachment mechanism including a loop or fastener (e.g. double d-ring, snap closure, Velcro™, etc.) on both ends for attachment to the goal frame 102. The supportive strap 210 assists in keeping the bottom edge of the target 202 taut and flat against the ground when coupled to the goal frame 102.

Note that the target 202 and removable target device 100 may be used independent of each other or in combination with one another. For example, in a first mode of use, the target 202 may be coupled to the goal frame 102 without the removable target device 100. In a second mode of use, the removable target device 100 may be coupled to the goal frame 102 without the target 202. In a third mode of use, the removable target device 100 and the target 202 may be coupled together and also to the goal frame 102.

Figure 3:
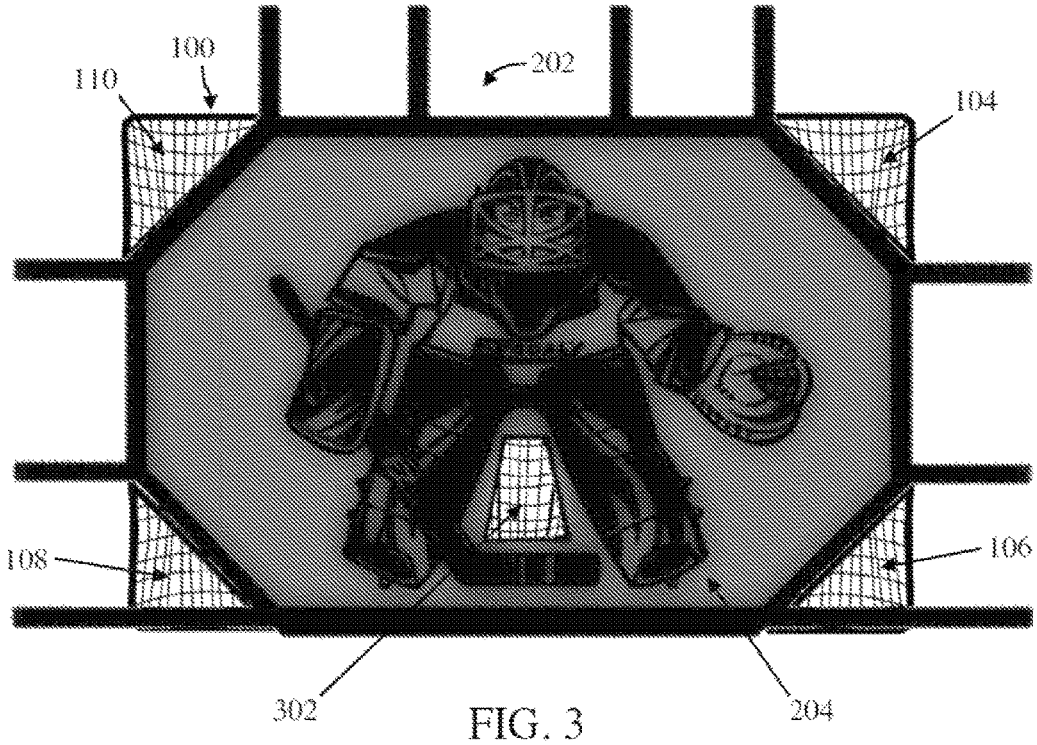
FIG. 3 illustrates a front view of the exemplary target of FIG. 2 with target pockets that may be removably coupled to the goal frame.

FIG. 3 illustrates a front view of the exemplary target 202 of FIG. 2 with target pockets 104, 106, 108, and 110 that may be removably coupled to the goal frame 102. As can be perceived, an additional pocket 302 has been coupled to the opening 204.

Figure 4:
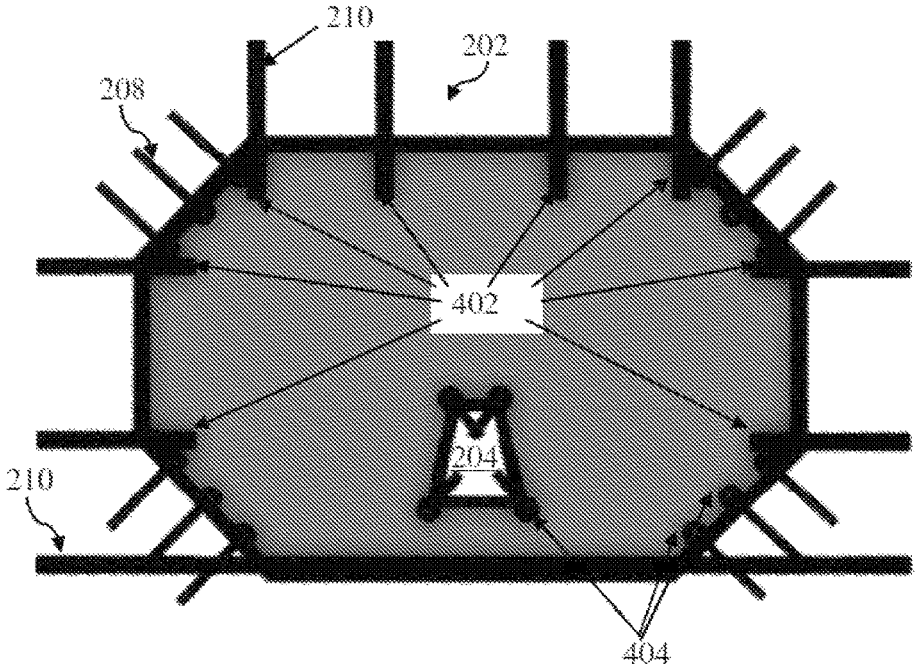
FIG. 4 illustrates a back view of the exemplary target of FIG. 2 that may be removably coupled to the goal frame.

FIG. 4 illustrates a back view of the exemplary target 202 of FIG. 2 that may be removably coupled to the goal frame 102. The target 202 may be equipped with at least one fastening mechanism 402 (including a double d-ring, snap closure, strip of Velcro™, or the like) for attaching the target 202 to the goal frame 102 and/or additional fastening mechanisms 404 for coupled the target 202 to target pockets 104, 106, 108, 110, 302 and for pulling/stretching the target 202 taut and/or flat across the goal frame 102.

Figure 5:
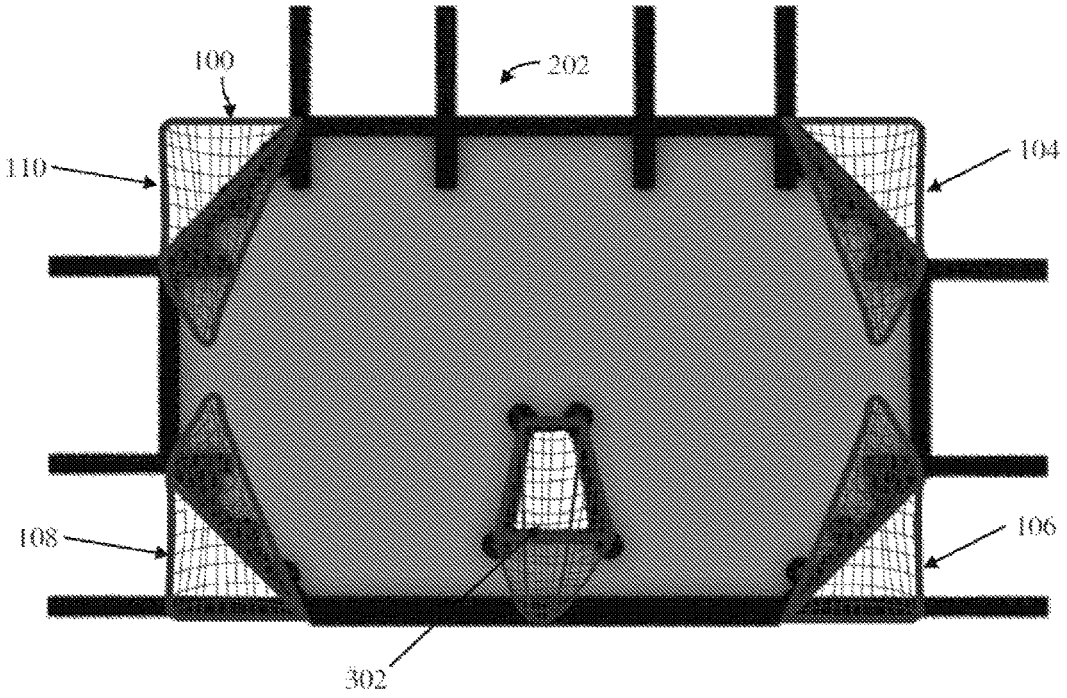
FIG. 5 illustrates a back view of the exemplary target of FIG. 2 with the target pockets of FIG. 1 coupled together.

FIG. 5 illustrates a back view of the exemplary target 202 of FIG. 2 with the target pockets 104, 106, 108, and 110 of FIG. 1 coupled together.

Figure 6:
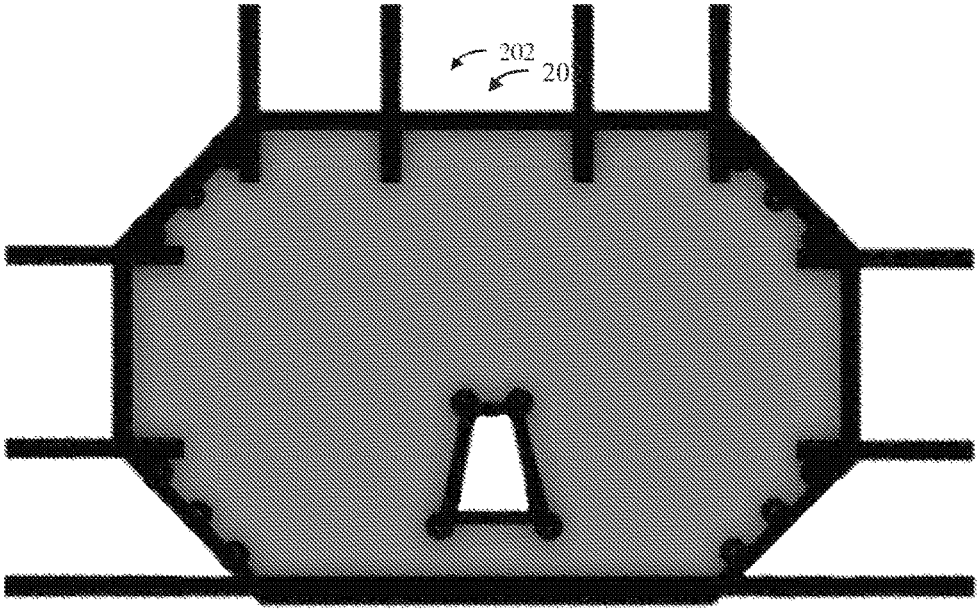
FIG. 6 illustrates a back view of the exemplary target of FIG. 2 in which the plurality of target pocket fasteners for the target pockets have been removed or bundled out of the way.

FIG. 6 illustrates a back view of the exemplary target 202 of FIG. 2 in which the plurality of target pocket fasteners 208 for the target pockets have been removed or bundled out of the way.

Figure 7:
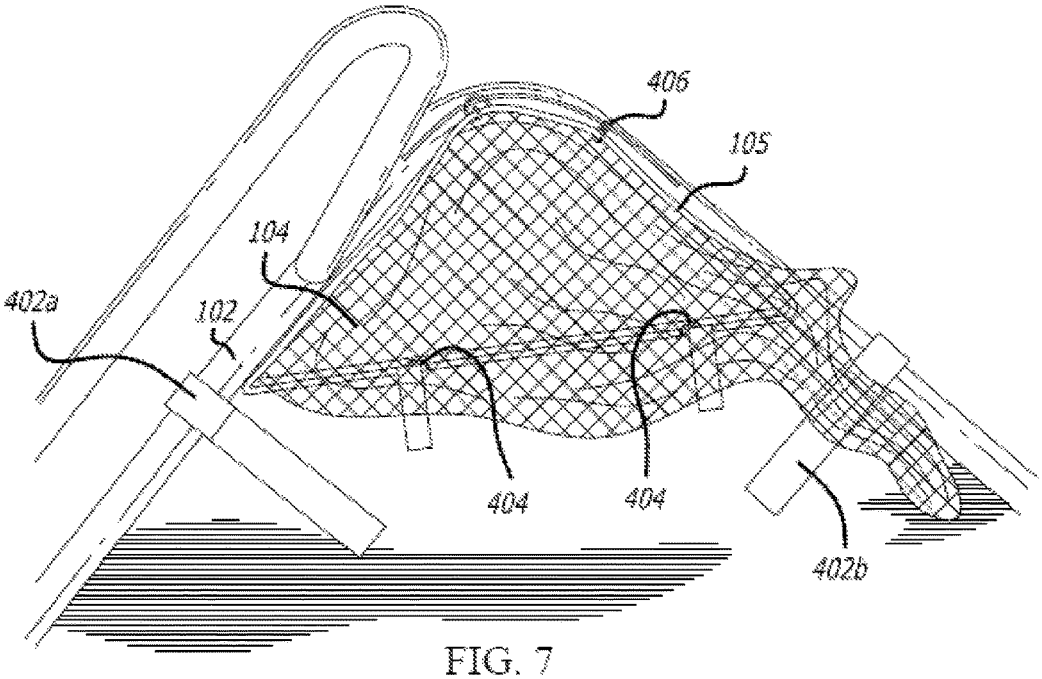
FIG. 7 illustrates a close-up view of a top corner of a goal frame with the removable target device of FIG. 1 and target of FIG. 2 installed.

FIG. 7 illustrates a close-up view of a top corner of a goal frame with the removable target device 100 of FIG. 1 and target 202 of FIG. 2 installed. The fastening element 105 may extend at least partially around the perimeter of the goal frame 102 and is equipped with an adjustment mechanism 404 (e.g., double D-rings that receive target pocket fasteners 208) for pulling the target pocket fastener 208 taut as when coupled to the goal frame 102. Another fastening mechanism 402 may serve to secure the plurality of frame fasteners 206 around the goal frame 100. The target pocket 104 may be adapted to be removably coupled to the goal frame 102 by some fastening mechanism 406, such as hook, double d-ring, snap closure, Velcro™, or the like, that attaches to a receiving mechanism on the goal frame 102.

Figure 8:
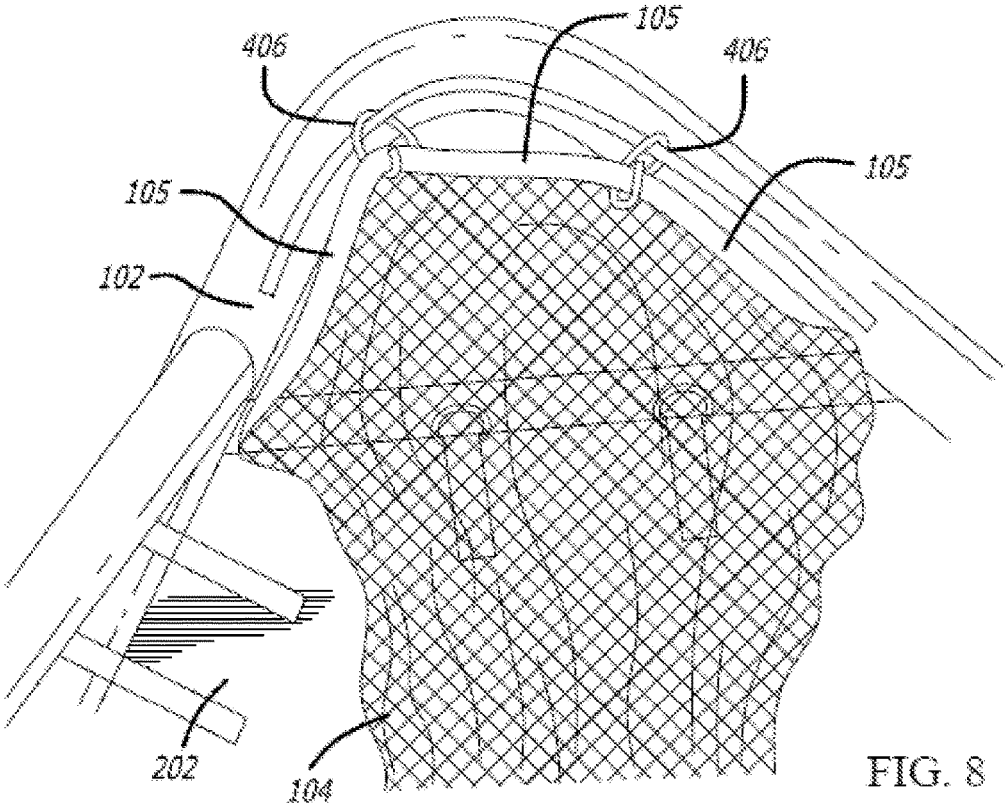
FIG. 8 illustrates another close-up view of the corner of a goal frame with the removable target device of FIG. 1 and target of FIG. 2 installed.

FIG. 8 illustrates another close-up view of the corner of a goal frame 102 with the removable target device 100 of FIG. 1 and target 202 of FIG. 2 installed.

Figure 9:
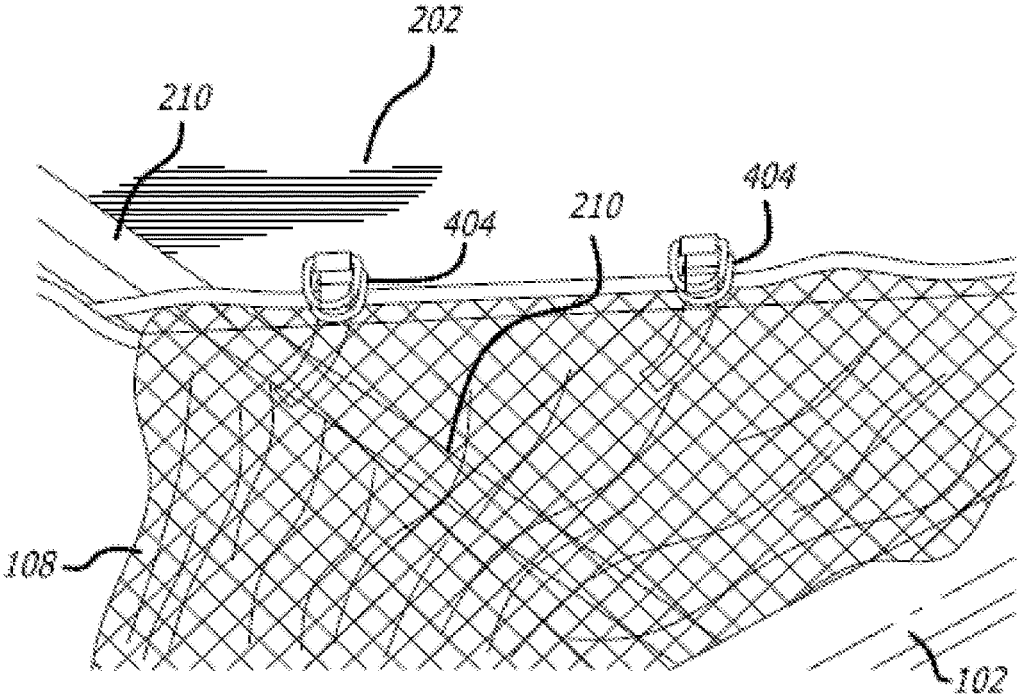
FIG. 9 illustrates a close-up view of a bottom corner of a goal frame with the removable target device 100 of FIG. 1 and target of FIG. 2 installed.

FIG. 9 illustrates a close-up view of a bottom corner of a goal frame with the removable target device 100 of FIG. 1 and target 202 of FIG. 2 installed. As can be appreciated here, the supportive strap 210 helps keep the bottom edge of the target pocket 108 tight.

Figure 10:
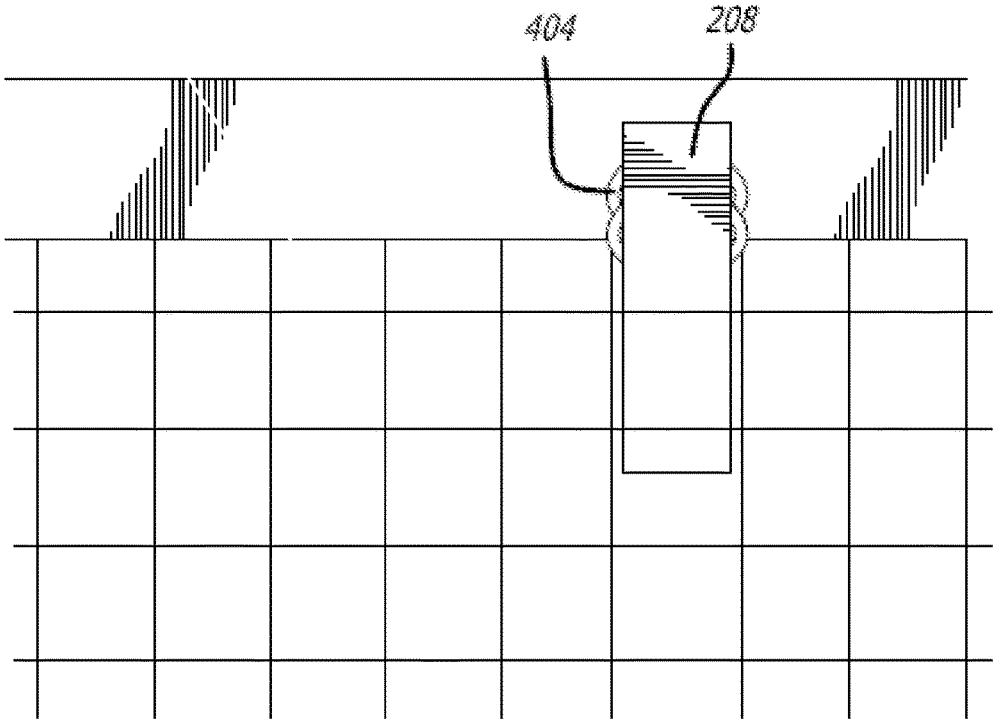
FIG. 10 illustrates a close-up view of a target pocket fastener coupled to an adjustment mechanism (e.g., double D-rings) of a target.

FIG. 10 illustrates a close-up view of a target pocket fastener 208 coupled to an adjustment mechanism 404 (e.g., double D-rings) of a target 202.

Although the invention has been described with regard to certain preferred example embodiments, it is to be understood that the present disclosure has been made by way of example only, and that improvements, changes and modifications in the details of construction and the combination and arrangement of parts may be resorted to without departing from the spirit and scope of the invention. Such improvements, changes and modifications within the skill of the art are intended to be covered by the scope of the present disclosure and claims.

What is claimed is:

1. An assembly for modifying/adapting a sporting goal comprising:

a target adapted to be removably coupled to a front frame of the sporting goal, the target comprising a one-piece non-rigid flexible material in an octagonal shape that extends across the front frame of the sporting goal and directly couples to at least three sides of the front frame of the sporting goal, with no horizontal support member along the bottom face of a sporting goal, the target further including a flexible supportive strap proximate to a bottom edge of the target for enabling the target to remain taut and flat when coupled across two opposite sides of the front frame of the sporting goal;

a plurality of target pockets adapted to be removably directly coupled to the front frame of the sporting goal and the target, wherein at least two of the plurality of target pockets are coupled together by a flexible fastening element that extends around three sides of a perimeter of the front frame, and wherein the sporting goal is configurable to be used independent of the target and target pockets; and wherein the octagonal shape of the target is adapted to provide space for at least a portion of the plurality of target pockets.

2. The assembly of claim 1, wherein in a first mode of usage the target and plurality of target pockets are both removably coupled to the sporting goal.

3. The assembly of claim 2, wherein in a second mode of usage only the plurality of target pockets are removably coupled to the sporting goal.

4. The assembly of claim 3, wherein in a third mode of usage only the target is removably coupled to the sporting goal.

5. The assembly of claim 1, further comprising:

one or more additional target pockets adapted to be removably coupled to one or more openings defined within the target.

6. The assembly of claim 1, further comprising:

a pocket fastener adapted to be removably coupled to the front frame of the sporting goal and/or the plurality of target pockets.

7. The assembly of claim 6, wherein the pocket fastener further comprises:

an adjustment mechanism for pulling the pocket fastener taut when coupled to the front frame of the sporting goal and/or plurality of target pockets.

8. The assembly of claim 7, wherein the pocket fastener removably couples two target pockets removably positioned proximate to the bottom left and bottom right corners of the front frame of the sporting goal.

9. The assembly of claim 1, wherein the target covers/obstructs at least 50% of the front opening/entryway of the sporting goal.

10. The assembly of claim 1, wherein at least some of the plurality of target pockets are individually and removably coupled to the front frame of the sporting goal and the target.

11. The assembly of claim 1, wherein a first target pocket and a second target pocket are coupled together using a first fastening element while a third target pocket and a fourth target pocket are coupled together using a second fastening element.

12. The assembly of claim 1, further comprising:

a plurality of frame fasteners adapted to couple a perimeter of the target to a first and a second vertical support member of the front frame of the sporting goal and a top horizontal support member of the front frame of the sporting goal, wherein the plurality of frame fasteners includes at least one of a double d-ring, a snap closure or a strip of Velcro™.

13. The assembly of claim 1, further comprising:

an image of a goalie imprinted on the target; and at least one opening in the target to which one of the plurality of target pockets is adapted to be removably coupled, wherein the opening is located in a region of the target corresponding to that between the goalie legs.

14. An assembly for modifying/adapting a sporting goal comprising:

a target means for partially blocking an opening defined by the sporting goal, the target means adapted to be removably coupled to a front frame of the sporting goal, the target means comprising a one-piece non-rigid flexible material in an octagonal shape that extends across the front frame of the sporting goal and directly couples to at least three sides of the front frame of the sporting goal, with no horizontal support member along a bottom face of the sporting goal, the target means further including a flexible supportive strap proximate to a bottom edge of the target means for enabling the target means to remain taut and flat when coupled across two opposite sides of the front frame of the sporting goal;

a target pocket means for catching an object, the target pocket means adapted to be removably directly coupled to the front frame of the sporting goal and the target means by a fastening means that wherein at least two of the plurality of target pocket means are coupled together by a flexible fastening means extends around three sides of a perimeter of the front frame, and wherein the sporting goal is configurable to be used independent of the target means and target pocket means;

and wherein the octagonal shape of the target means is adapted to provide space for the target pocket means.

15. A kit for modifying/adapting a sporting goal comprising:

a plurality of target pockets adapted to be removably directly coupled to the corners of a front frame of the sporting goal;

a target adapted to be removably coupled to the front frame of the sporting goal and the plurality of target pockets, the target comprising a one-piece non-rigid flexible material in an octagonal shape that extends across the front frame of the sporting goal and directly couples to at least three sides of the front frame of the sporting goal, with no horizontal support member along a bottom face of the sporting goal, the target further including a flexible supportive strap proximate to the bottom edge of a target for enabling the target to remain taut and flat when coupled across two opposite sides of the front frame of the sporting goal, wherein at least two of the plurality of target pockets are coupled together by a flexible fastening element that extends around three sides of a perimeter of the front frame, and wherein the sporting goal is configurable to be used independent of the target and target pockets;

and wherein the octagonal shape of the target is adapted to provide space for at least a portion of the plurality of target pockets.

16. The kit of claim 15, wherein a first mode of usage the target and plurality of target pockets are both removably coupled to the sporting goal.

17. The kit of claim 16, wherein in a second mode of usage only the plurality of pockets are removably coupled to the sporting goal.

18. The kit of claim 17, wherein in a third mode of usage only the target is removably coupled to the sporting goal.

* * * * *